US012742388B2

(12) United States Patent
Meng et al.

(10) Patent No.: US 12,742,388 B2
(45) Date of Patent: Sep. 22, 2026

(54) METHOD AND DEVICE FOR PREVENTING RIB SPALLING IN HIGH-STRESS SURROUNDING ROCK BY HYDRAULIC SLOTTING

(71) Applicants: CHINA UNIVERSITY OF MINING AND TECHNOLOGY, Xuzhou City (CN); YUNLONG LAKE LABORATORY OF DEEP EARTH SCIENCE AND ENGINEERING, Jiangsu Province (CN)

(72) Inventors: Bo Meng, Xuzhou City (CN); Bangguo Jia, Jiangsu Province (CN); Hongwen Jing, Xuzhou City (CN); Jingkui Long, Xuzhou City (CN); Xiaozhao Li, Xuzhou City (CN); Dajiang Liu, Xuzhou City (CN); Yanjun Qi, Xuzhou City (CN); Qian Yin, Xuzhou City (CN); Jinghua Qi, Xuzhou City (CN); Yingchao Wang, Xuzhou City (CN); Tao Wang, Xuzhou City (CN); Runda Yang, Xuzhou City (CN); Liang Wen, Xuzhou City (CN)

(73) Assignees: CHINA UNIVERSITY OF MINING AND TECHNOLOGY, Xuzhou City (CN); YUNLONG LAKE LABORATORY OF DEEP EARTH SCIENCE AND ENGINEERING, Jiangsu Province (CN)

( * ) Notice: Subject to any disclaimer, the term of this patent is extended or adjusted under 35 U.S.C. 154(b) by 39 days.

(21) Appl. No.: 18/900,175

(22) Filed: Sep. 27, 2024

(65) Prior Publication Data

US 2025/0215798 A1 Jul. 3, 2025

(30) Foreign Application Priority Data

Jan. 3, 2024 (CN) ..... 202410006948.1

(51) Int. Cl.
*E21C 37/12* (2006.01)

(52) U.S. Cl.
CPC ..... *E21C 37/12* (2013.01)

(58) Field of Classification Search
CPC ..... E21B 7/18; E21C 37/12; E21D 9/1066
See application file for complete search history.

(56) References Cited

U.S. PATENT DOCUMENTS 10,774,591 B2 * 9/2020 Wang ..... E21B 33/127

FOREIGN PATENT DOCUMENTS

AU 2016363855 B2 * 8/2018 ..... E21B 21/013
AU 2020102687 A4 * 12/2020 ..... E21F 7/00

(Continued)

*Primary Examiner* — Amber R Anderson
(74) *Attorney, Agent, or Firm* — Pillsbury Winthrop Shaw Pittman LLP

(57) ABSTRACT

A method and device for preventing rib spalling in a high-stress surrounding rock by hydraulic slotting are provided. The construction steps include: obtaining mechanical parameters of a surrounding rock and determine a width of each of pressure relief grooves; opening four drilling holes along an excavation direction of a roadway, and the four drilling holes are arranged at two sides of the roadway in pairs, and two of the drilling holes, located at the same side, are arranged at a bottom and a top of the roadway respectively; hydraulically slotting the drilling holes towards the roadway in a horizontal direction to form the pressure relief grooves; and excavating the surrounding rock to form the roadway, and the roadway is in communication with the pressure relief grooves.

3 Claims, 15 Drawing Sheets

(56) References Cited

FOREIGN PATENT DOCUMENTS

| | | | | | |
|---|---|---|---|---|---|
| CN | 107201892 | A | * | 9/2017 | ..... E21F 7/00 |
| CN | 109026070 | A | * | 12/2018 | ..... E21D 11/14 |
| CN | 110513141 | B | * | 5/2021 | ..... E21F 7/00 |
| CN | 113090263 | A | * | 7/2021 | ..... E21B 7/04 |
| CN | 113153296 | A | * | 7/2021 | ..... E21C 41/18 |
| CN | 113882855 | A | * | 1/2022 | ..... E21C 25/60 |
| CN | 113931608 | A | * | 1/2022 | ..... E21B 7/18 |
| CN | 114658474 | A | * | 6/2022 | ..... E21F 7/00 |
| CN | 115142893 | A | * | 10/2022 | ..... E21B 43/26 |
| CN | 115182744 | A | * | 10/2022 | ..... E21D 9/1066 |

* cited by examiner

METHOD AND DEVICE FOR PREVENTING RIB SPALLING IN HIGH-STRESS SURROUNDING ROCK BY HYDRAULIC SLOTTING

CROSS-REFERENCE TO RELATED APPLICATIONS

This application claims priority to Chinese Patent Application No. 202410006948.1, filed on Jan. 3, 2024, the contents of which are hereby incorporated by reference.

TECHNICAL FIELD

The disclosure belongs to the technical field of roadway support, in particular to a method and device for preventing rib spalling in a high-stress surrounding rock by hydraulic slotting.

BACKGROUND

With the increase of the scale of deep-buried roadway, the in-situ stress of roadway also increases, which has more obvious influence on the deformation of the surrounding rock. Different from the shallow roadway in the past, deep-buried roadway shows nonlinear large deformation phenomenon, which requires innovative solutions.

Pressure relief technology has become an efficient method to solve these challenges, which significantly enhances the stability of the surrounding rock and helps to better control the stability of roadway. Although the pressure relief technology has achieved good results, its limitations must be acknowledged. For example, blasting pressure relief destroys the integrity of the surrounding rock, which is unsafe. The drilling and pressure relief have a large workload and take long in time. Most pressure relief technologies are based on man-made destruction of the integrity of the surrounding rock, creating pressure relief spaces to achieve the ideal purpose of pressure relief. However, these pressure relief technologies are bound to reduce the strength and bearing capacity of the surrounding rock.

Therefore, a method and device for preventing rib spalling in the high-stress surrounding rock by hydraulic slotting are provided to solve the above problems.

SUMMARY

In order to solve the above technical problems, the disclosure provides a method and device for preventing rib spalling in the high-stress surrounding rock by hydraulic slotting, which may realize pressure relief before roadway excavation, avoid the influence on normal work caused by pressure relief after roadway excavation, and have high pressure relief efficiency, and may ensure the stability of the surrounding rock and prevent rib spalling.

In order to achieve the above objective, the disclosure provides a method for preventing rib spalling in a high-stress surrounding rock by hydraulic slotting, and construction steps include:

obtaining mechanical parameters of the surrounding rock and determine a width of each of pressure relief grooves;

opening four drilling holes along an excavation direction of a roadway, where the four drilling holes are arranged at two sides of the roadway in pairs, and two of the drilling holes, located at a same side, are arranged at a bottom and a top of the roadway respectively;

hydraulically slotting the drilling holes towards the roadway in a horizontal direction to form the pressure relief grooves; and excavating the surrounding rock to form the roadway, where the roadway is in communication with the pressure relief grooves.

Further, the surrounding rock is simulated by a discrete element software UDEC and the width of each of the pressure relief grooves is determined.

Further, the hydraulically slotting is carried out on each drilling hole in the horizontal direction, and the slotting moves in segments from near an open end of the drilling hole to a direction away from the open end of the drilling hole.

Further, the drilling holes are hydraulically slotted in the horizontal direction, and rock debris in the drilling holes is discharged in segments.

Further, each of the drilling holes is opened in a middle of a corresponding one of the pressure relief grooves, so that the corresponding one of the pressure relief grooves extends to two sides of the each of the drilling holes in the horizontal direction.

Further, after the roadway is formed, a roof of the roadway is supported and reinforced.

A device for preventing rib spalling in a high-stress surrounding rock by hydraulic slotting is provided, which is used for constructing the method for preventing rib spalling in the high-stress surrounding rock by hydraulic slotting.

The device includes a high-pressure spray head, where one end of the high-pressure spray head is connected with a drill pipe and an other end of the high-pressure spray head extends into each of the drilling holes, and the high-pressure spray head is configured to output a medium to form a corresponding one of the pressure relief grooves; and a liquid supply unit, where a liquid outlet end of the liquid supply unit is in communication with the high-pressure spray head.

Further, the device also includes a height-adjusting bracket configured to be adjustable in a height direction; and a horizontal guide rail fixed at a top end of the height-adjusting bracket, where the horizontal guide rail is slidably connected with the drill pipe through grooves on the drill pipe.

Further, the device also includes a pressure control valve connected to the liquid inlet end of the high-pressure spray head and configured to control a pressure at a liquid outlet end of the high-pressure spray head; and a pressure gauge connected to the liquid inlet end of the high-pressure spray head and configured to obtain the pressure at the liquid outlet end of the high-pressure spray head.

Further, the liquid supply unit includes a water tank; and a mixed abrasive box, where a water inlet end of the mixed abrasive box is in communication with a water outlet end of the water tank, and a liquid outlet end of the mixed abrasive box is in communication with the liquid inlet end of the high-pressure spray head.

Compared with the prior art, the disclosure has the following advantages and technical effects.

Compared with the existing roadway pressure relief methods, this method completes pressure relief in advance before roadway excavation, and thus avoiding the need for pressure relief after roadway excavation, and ensuring that the normal work is not affected.

By arranging four drilling holes along the excavation direction of the roadway, the pressure relief grooves are formed by drilling holes respectively, so that the four pressure relief grooves are located at the four corners of the roadway respectively, and the surrounding rock pressure of the two ribs of the roadway is reduced.

Compared with the existing blasting pressure relief methods, this method is safer to use hydraulic slotting to construct pressure relief grooves.

BRIEF DESCRIPTION OF THE DRAWINGS

The accompanying drawings, which constitute a part of the disclosure, are used to provide a further understanding of the disclosure. The illustrative embodiments of the disclosure and their descriptions are used to explain the disclosure, and do not constitute an improper limitation of the disclosure. In the attached drawings.

DETAILED DESCRIPTION OF THE EMBODIMENTS

Figure 1:
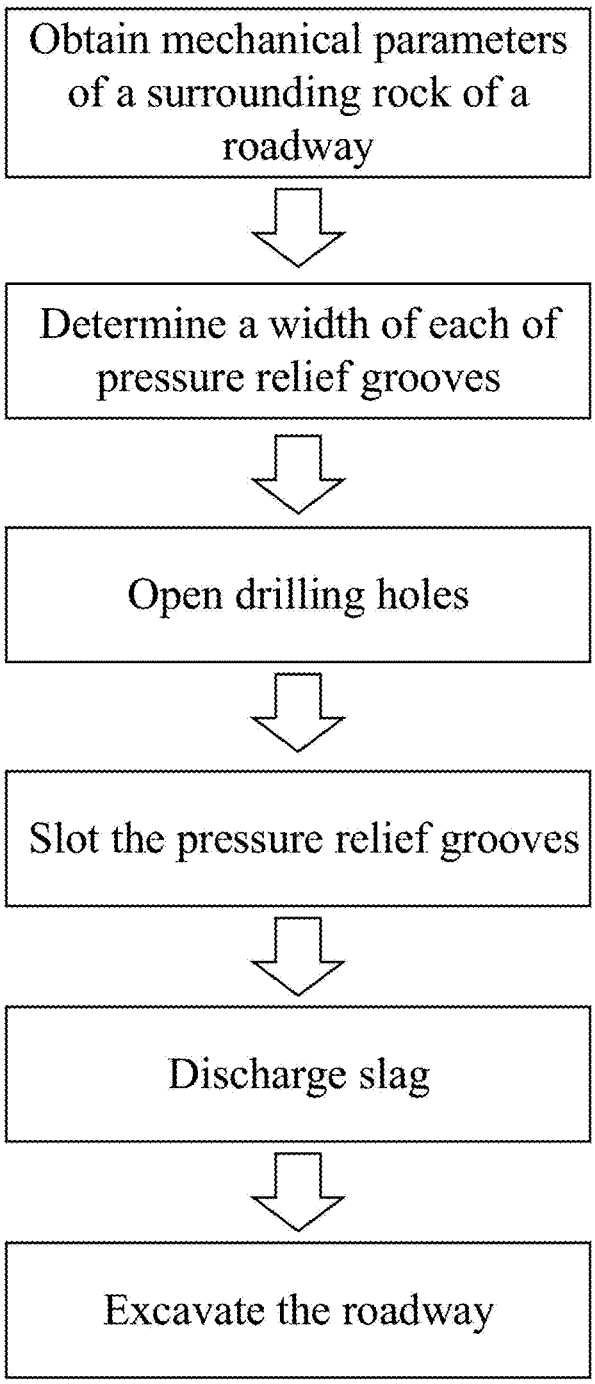
FIG. 1 is a schematic diagram of a pressure relief slotting process.
Figure 2:
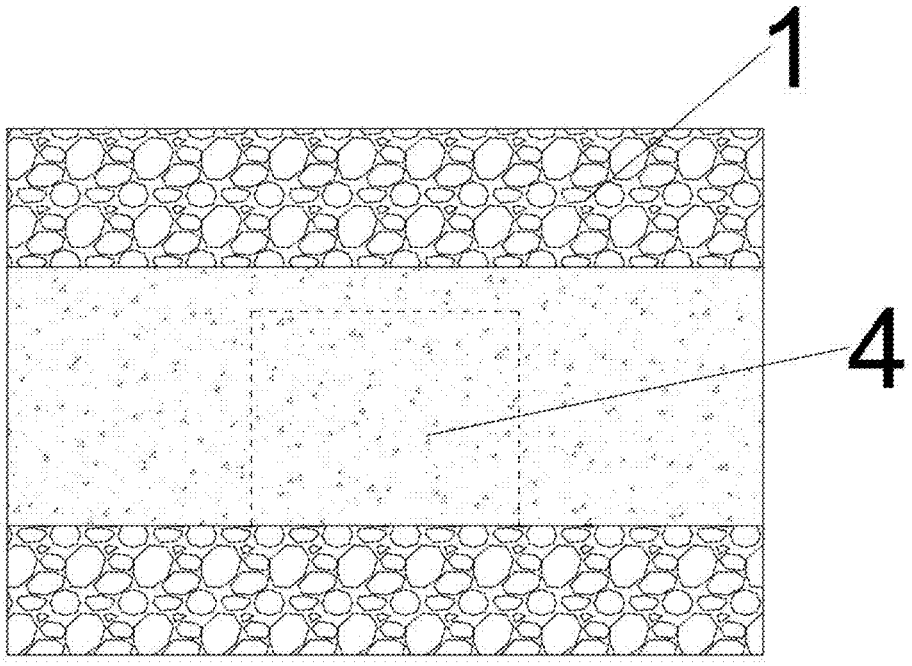
FIG. 2 is a front view of a positional relationship between a surrounding rock and a roadway to be excavated.
Figure 3:
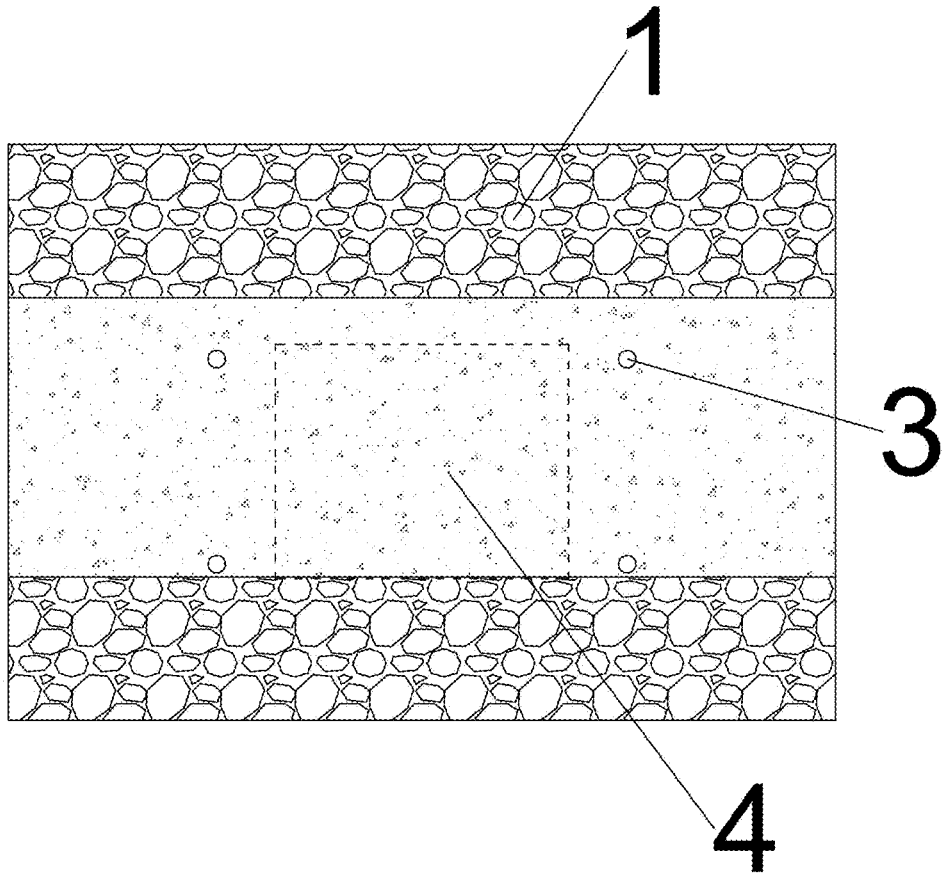
FIG. 3 is a front view of a positional relationship between drilling holes and the roadway to be excavated.
Figure 4:
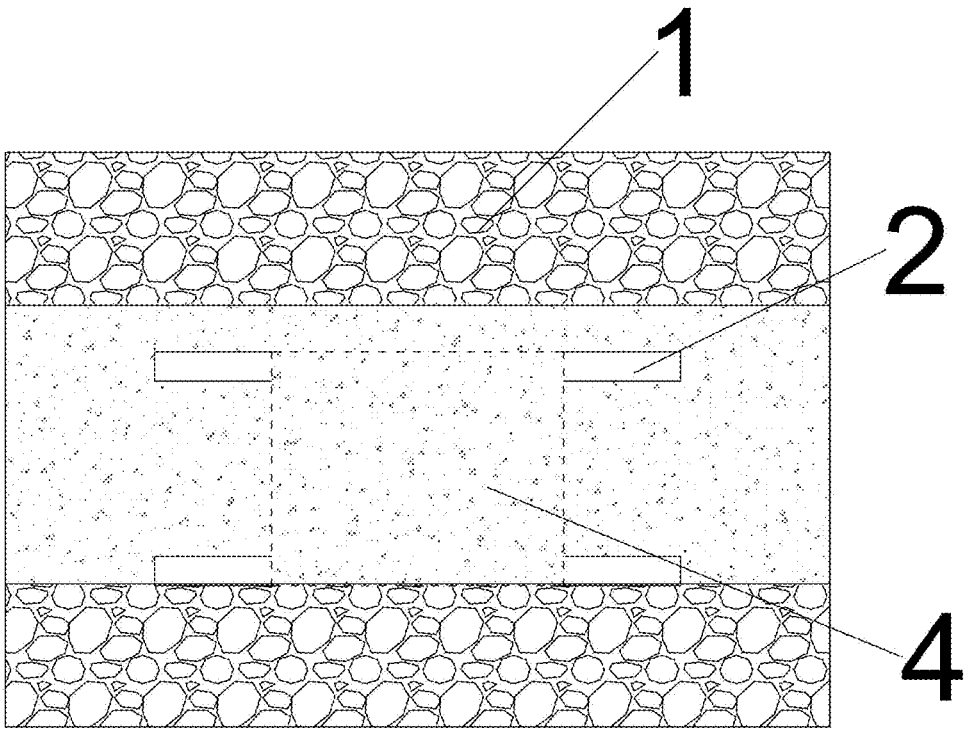
FIG. 4 is a front view of a position relationship between pressure relief grooves and the roadway to be excavated.
Figure 5:
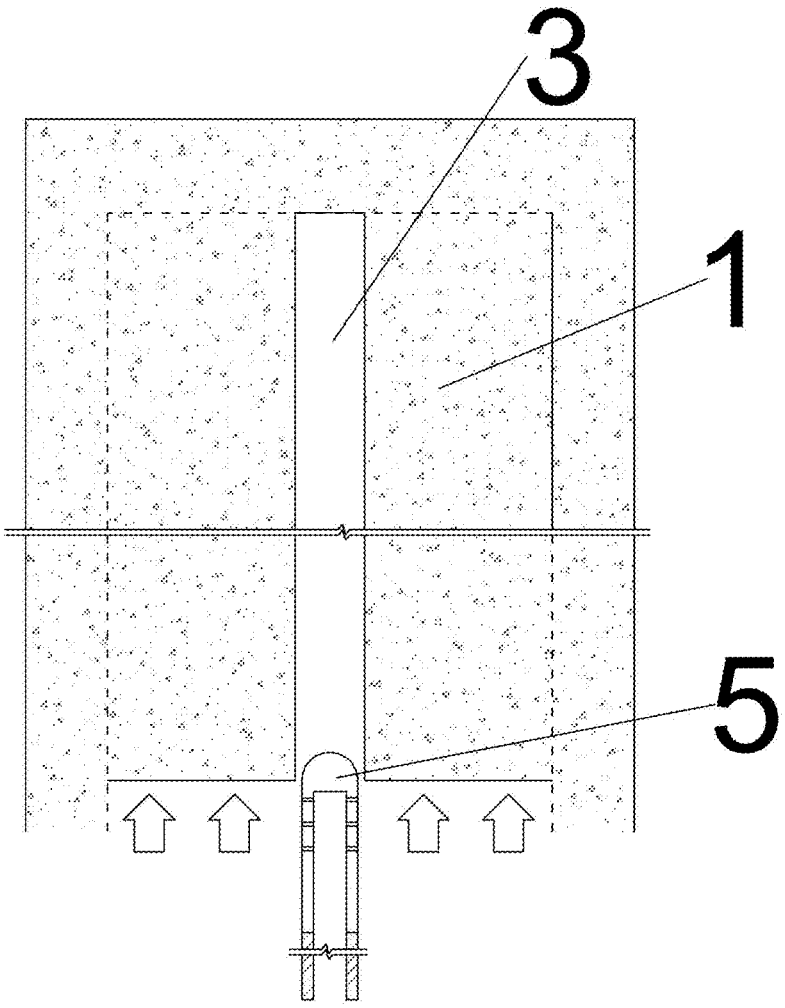
FIG. 5 is a top view of a positional relationship between the drilling hole and the surrounding rock.
Figure 6:
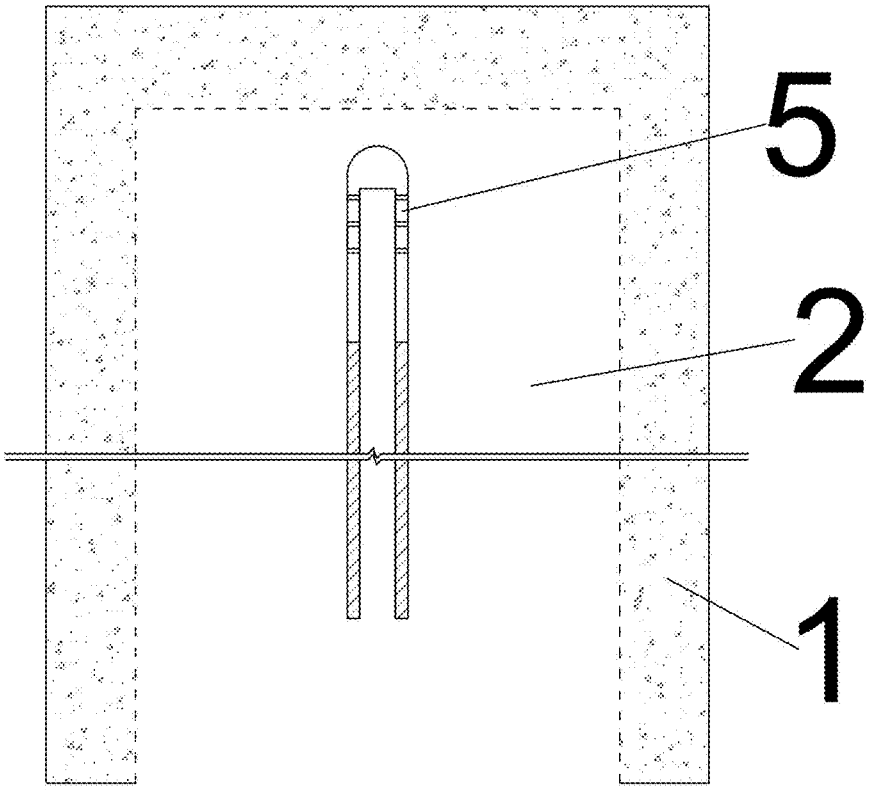
FIG. 6 is a top view of a positional relationship between the pressure relief groove and the surrounding rock.

In the following, the technical schemes in the embodiments of the disclosure will be clearly and completely described with reference to the attached drawings. Apparently, the described embodiments are only a part of the embodiments of the disclosure, but not all the embodiments. Based on the embodiments in the disclosure, all other embodiments obtained by those skilled in the art without creative effort belong to the protection scope of the disclosure.

In order to make the above objects, features and advantages of the disclosure more obvious and easier to understand, the disclosure will be further described in detail with the attached drawings and embodiments.

With reference to FIG. 1-FIG. 13, the disclosure provides a method for preventing rib spalling in a high-stress surrounding rock by hydraulic slotting, and includes the following construction steps.

Mechanical parameters of the surrounding rock 1 are obtained, and a width of each of pressure relief grooves 2 is determined.

According to the actual working conditions, a surrounding rock mechanics experiment is carried out on a roadway 4 which is about to be slotted for pressure relief, and mechanical parameters of the surrounding rock of the roadway in the field are obtained. Based on the mechanical parameters, numerical simulation is carried out, and the width of the pressure relief groove 2 is calculated.

Four drilling holes 3 are opened along an excavation direction of the roadway 4, and the four drilling holes 3 are arranged at two sides of the roadway 4 in pairs, and two drilling holes 3 which a located at the same side are arranged at a bottom and a top of the roadway 4 respectively.

Each of the four corners of the roadway 4 to be excavated is provided with a corresponding one of the drilling holes 3, and the drilling holes 3 are located at the bottom and the top of the two sides of the roadway 4 to be excavated, and are used for subsequently forming the pressure relief grooves 2. In this embodiment, the surrounding rock 1 includes rock strata and a coal seam, and the drilling holes are provided in the coal seam.

In some embodiments, a depth of the drilling hole 3 is 50 meters (m).

The drilling holes 3 are hydraulically slotted towards the roadway 4 in the horizontally direction so as to form the pressure relief grooves 2.

After the drilling hole 3 is opened, the slotting device is placed into the drilling hole 3, and the horizontal hydraulic slotting is carried out in the direction towards the roadway 4 to be excavated, so the drilling hole 3 is reamed to form a long mouth structure, and the long mouth structure is the pressure relief groove 2.

The surrounding rock 1 is excavated to form the roadway 4, and the roadway 4 is in communication with the pressure relief grooves 2.

After the construction of the pressure relief grooves 2 is completed, according to a predetermined plan, the roadway 4 is formed by excavation. Because the pressure relief grooves 2 are constructed in advance, after the construction of the roadway 4 is completed, one end of each pressure relief groove 2 close to the roadway 4 is in communication with the roadway 4.

In some embodiments, the surrounding rock 1 is simulated by a discrete element software UDEC, and the width of the pressure relief groove 2 is determined.

Specifically, rock mechanics parameters are obtained, and the width of the pressure relief groove 2 is determined by numerical simulation with the discrete element software UDEC.

In some embodiments of the disclosure, with reference to FIG. 10, FIG. 11, FIG. 12, FIG. 13, FIG. 14 and FIG. 15, according to the numerical simulation results of the discrete element software UDEC, it may be seen that a roadway 4 with pressure relief grooves 2 and a roadway 4 without pressure relief grooves 2 are set, a maximum horizontal displacement of a left rib of the roadway 4 without the pressure relief grooves 2 is 955.39 millimeters (mm), a maximum horizontal displacement of a right rib is 772.06 mm, and middle and upper surrounding rock of the roadway 4 without the pressure relief grooves 2 collapse, resulting in serious rib spalling phenomenon. A maximum horizontal displacement of a left rib and a right rib of the roadway 4 with the pressure relief grooves 2 is 176.88 mm and 185.81 mm respectively. A peak value of vertical stress in ribs of the roadway 4 without the pressure relief grooves 2 is 21.34 megapascal (MPa), and a depth from the rib is 3.32 m, while a peak value of vertical stress in ribs of the roadway 4 with the pressure relief grooves 2 is 20.37 MPa, and a depth from the rib is 3.90 m. It may be seen that the pressure relief grooves make the vertical stress of the ribs move to the deep part of the surrounding rock and an area of a plastic zone decreases significantly.

In some embodiments, the horizontal hydraulic slotting is carried out on each drilling hole 3, and the slotting moves in segments from near an open end of the drilling hole 3 to a direction away from the open end of the drilling hole 3.

Specifically, during the construction of the pressure relief grooves 2, a drill pipe 6 is used to drive a high-pressure spray head 5 to move in segments from an outer side of the drilling hole 3 to the deep, so as to realize segmented horizontal hydraulic slotting of the drilling hole 3.

In some embodiments, the drilling holes 3 are horizontally hydraulically slotted, and rock debris in the drilling holes 3 is discharged in segments.

Specifically, when the drilling hole 3 is horizontally slotted in segments, each of the segments has a slotting construction process and a slag discharge construction process, that is, during slotting construction, the high-pressure spray head 5 outputs a high-pressure medium to realize slotting construction. After the slotting construction is completed or the slotting construction reaches a predetermined depth, a pressure of the medium output by the high-pressure spray head 5 is reduced, and the rock debris is discharged from the drilling hole 3 by means of the medium.

In some embodiments, the drilling hole 3 is opened in the middle of the pressure relief groove 2, so that the pressure relief groove 2 extends to two sides of the drilling hole 3 in the horizontal direction.

Specifically, each of two sides of the high-pressure spray head 5 is provided with an output end, so when the high-pressure spray head 5 works, one output end outputs the medium to slot in the direction towards the roadway 4, and the other output end outputs the medium to slot in the direction away from the roadway 4. Under this structural arrangement, the construction duration of the pressure relief grooves 2 may be shortened, so the slotting efficiency is improved in unit time.

In a specific embodiment of the disclosure, the width of the pressure relief groove 2 is L, and the drilling hole 3 is set at a position 0.5 L away from the side rib of the roadway 4. When the high-pressure spray head 5 works, the slits are cut towards both sides of the drilling hole 3 synchronously.

In some embodiments, after the roadway 4 is formed, the roof of the roadway 4 is supported and reinforced.

Specifically, after the construction of the roadway 4 is completed, the section width of the roadway 4 is increased due to the existence of the pressure relief grooves 2, which leads to the increase of the stress on the roof. In order to ensure the safe temperature of the roof, the roof is supported.

Figure 7:
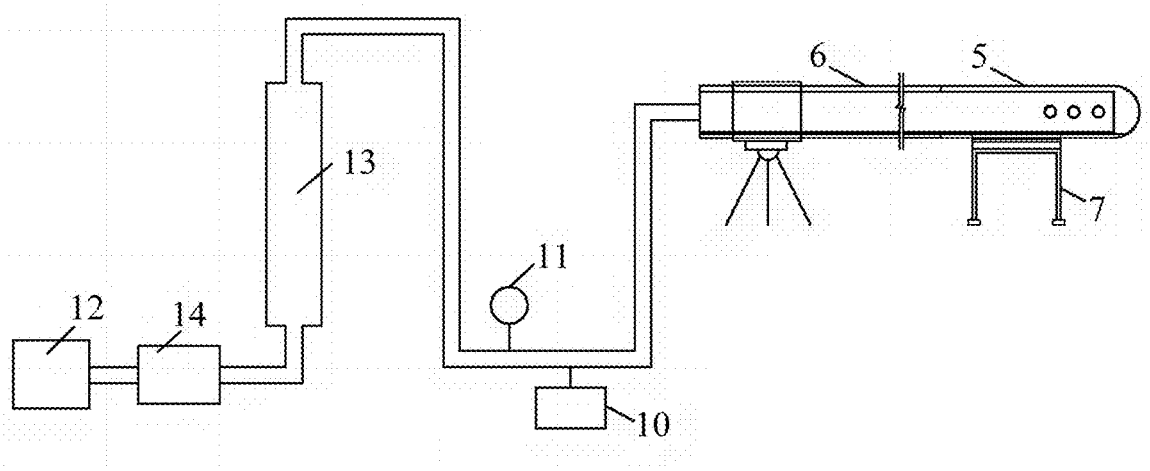
FIG. 7 is a schematic structural diagram of slotting device.
Figure 8:
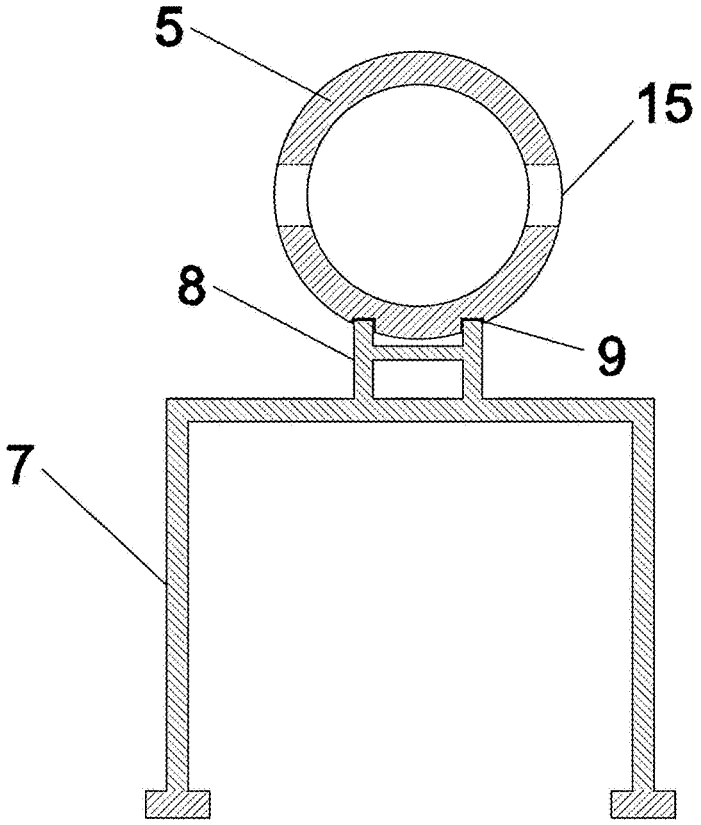
FIG. 8 is a structural schematic diagram of a connection relationship between a height-adjusting bracket and a high-pressure spray head.
Figure 9:
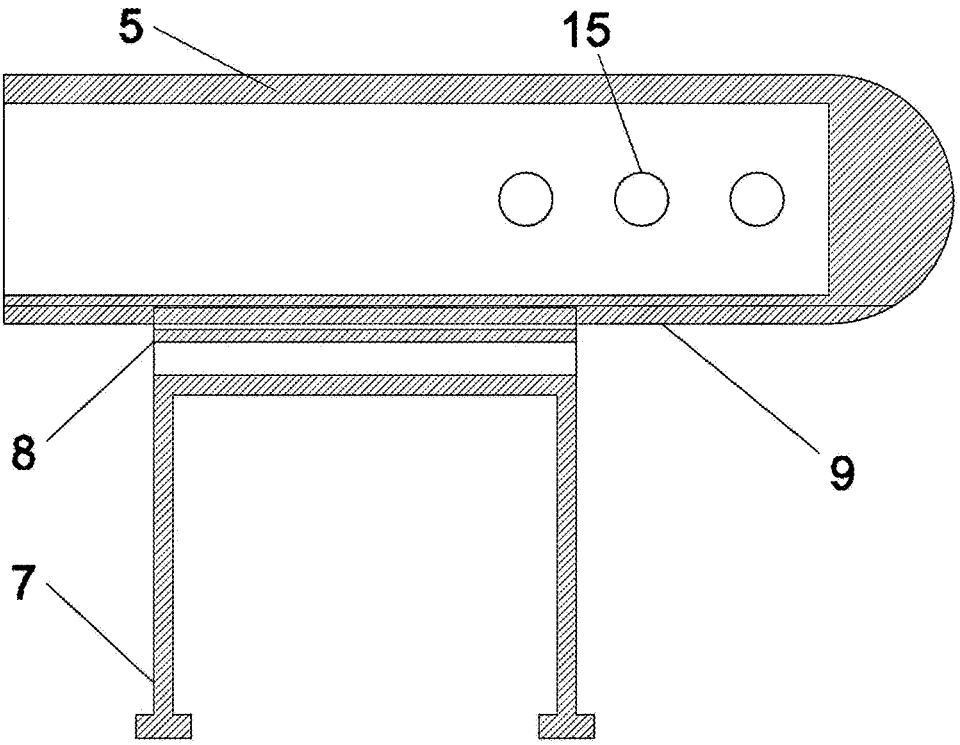
FIG. 9 is a structural schematic diagram of a positional relationship between a high-pressure spray head and nozzles.
Figure 10:
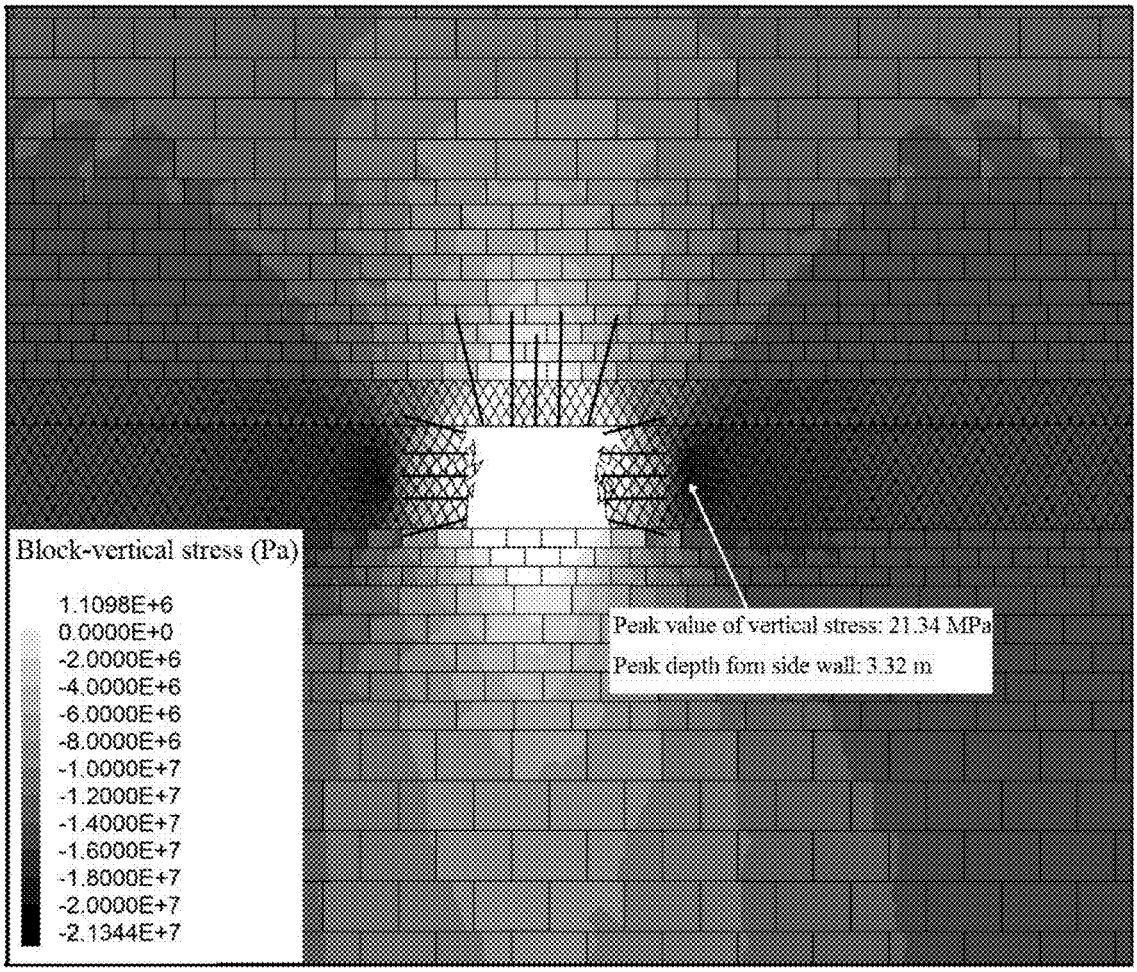
FIG. 10 is a schematic diagram of simulated stress without pressure relief grooves.
Figure 11:
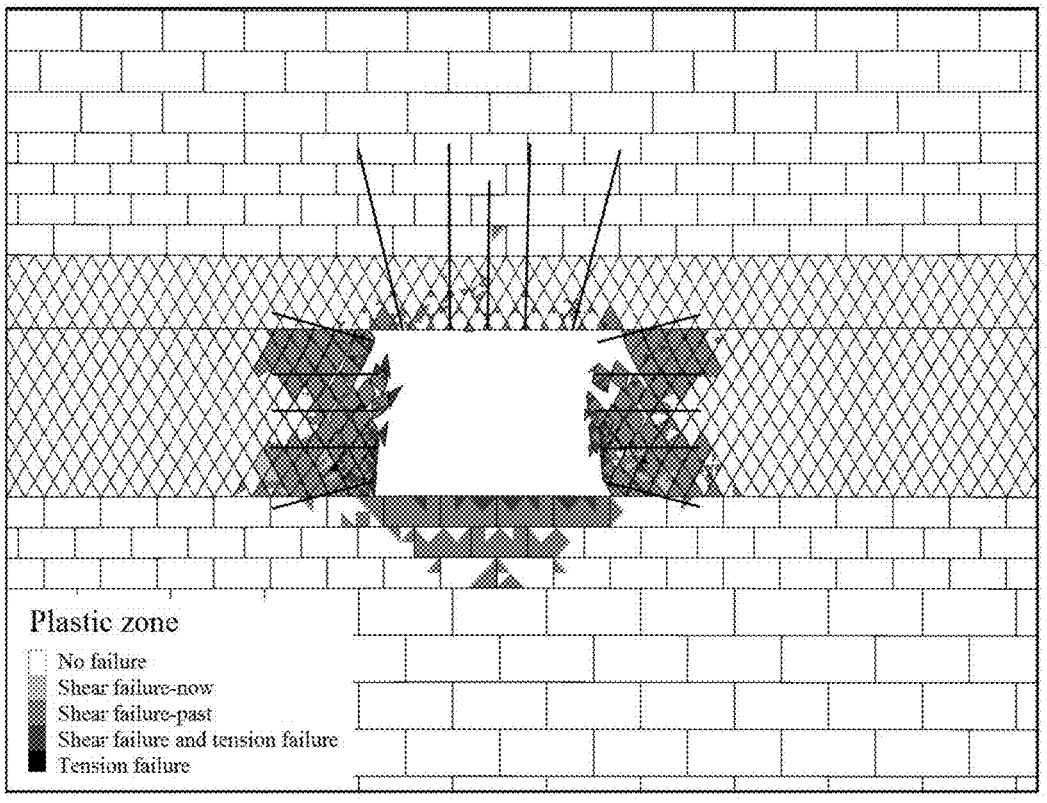
FIG. 11 is a schematic diagram of a simulated plastic zone without pressure relief grooves.
Figure 12:
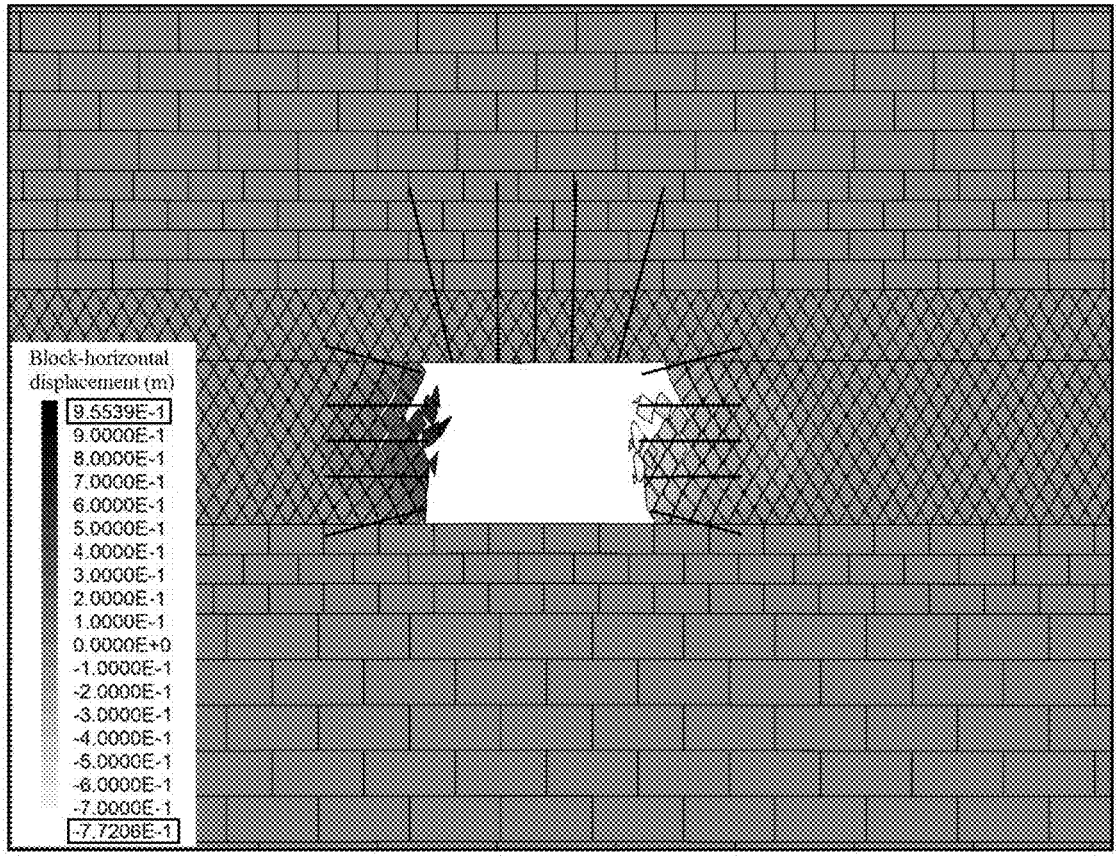
FIG. 12 is a schematic diagram of simulated horizontal displacement without pressure relief grooves.
Figure 13:
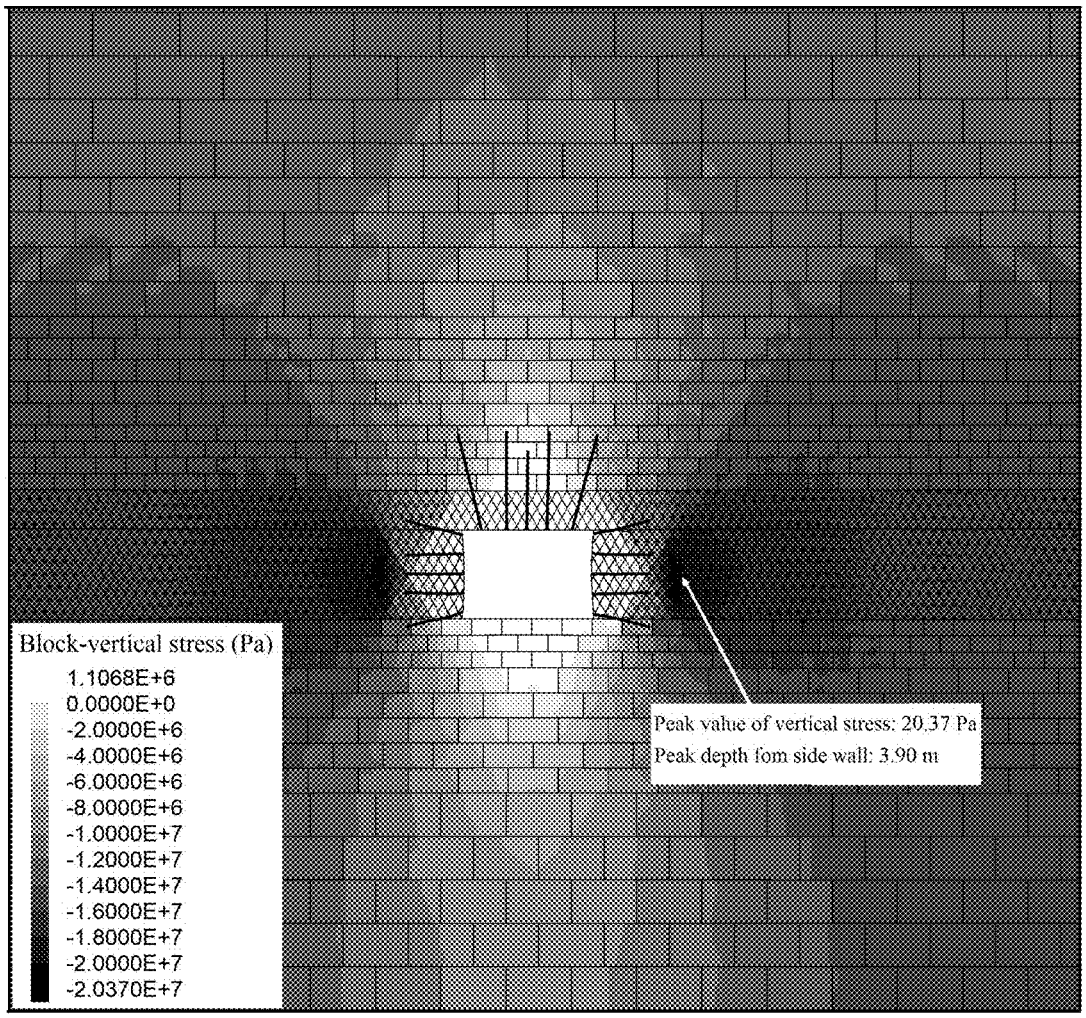
FIG. 13 is a schematic diagram of simulated stress with pressure relief grooves.
Figure 14:
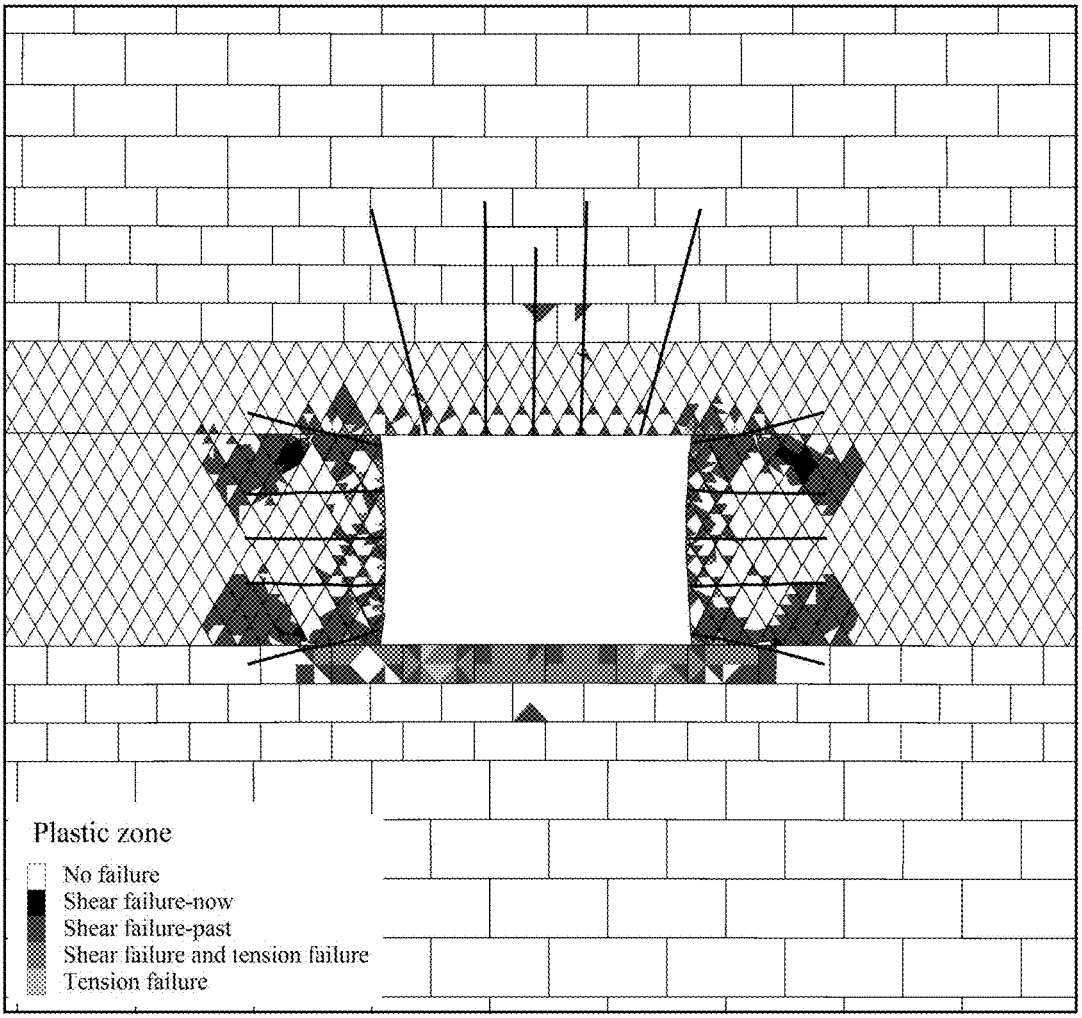
FIG. 14 is a schematic diagram of a simulated plastic zone with pressure relief grooves.
Figure 15:
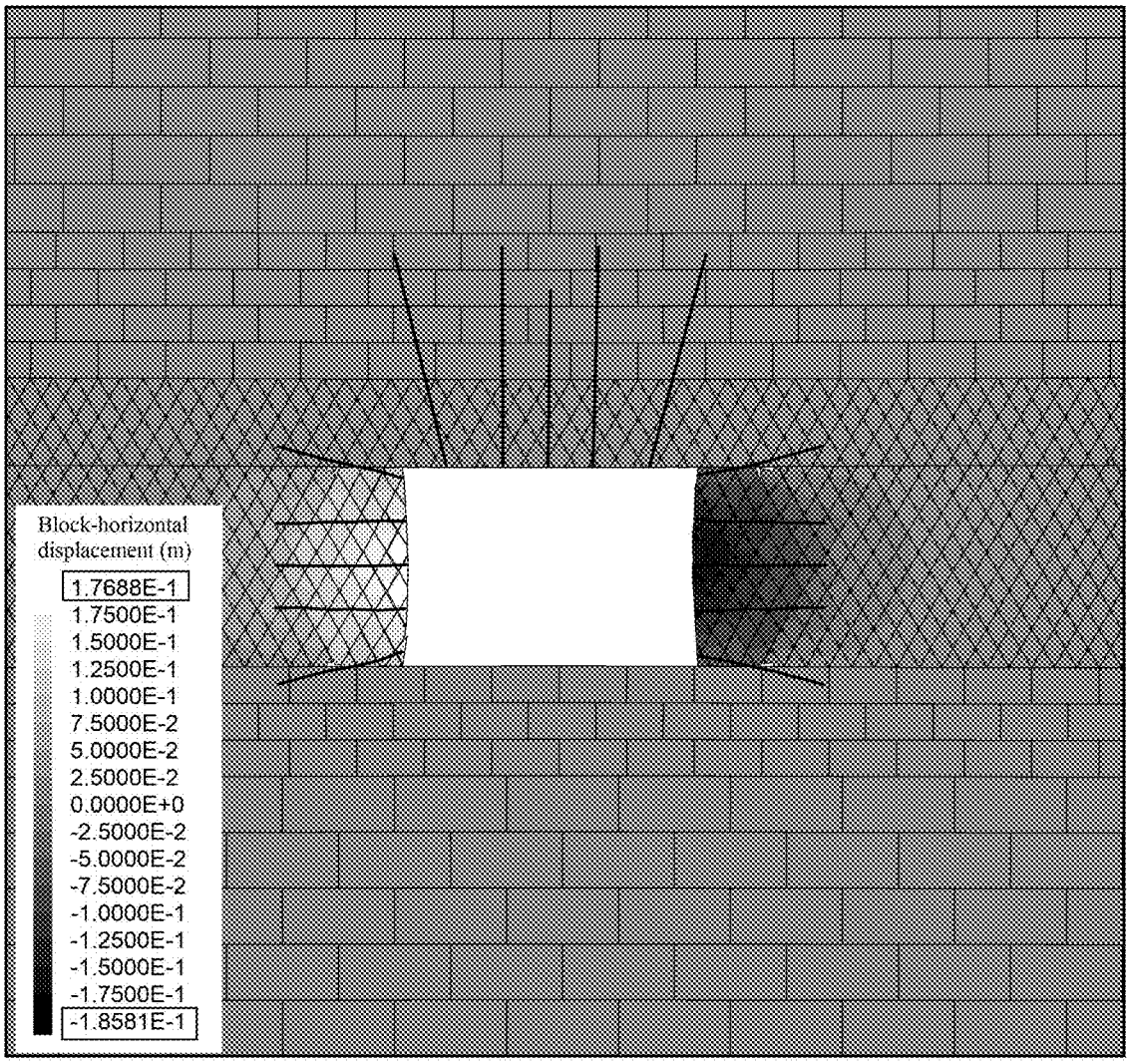
FIG. 15 is a schematic diagram of simulated horizontal displacement with pressure relief grooves.

With reference to FIG. 7, FIG. 8 and FIG. 9, a device for preventing rib spalling in the high-stress surrounding rock by hydraulic slotting is provided, which is used for constructing the above-mentioned method for preventing rib spalling in the high-stress surrounding rock by hydraulic slotting.

The device includes the high-pressure spray head 5, and one end of the high-pressure spray head 5 is connected to the drill pipe 6, grooves 9 are formed on the high-pressure spray head 5 and the drill pipe 6. And the other end of the high-pressure spray head 5 extends into the drilling hole 3. The high-pressure spray head 5 is configured to output the medium to form the pressure relief grooves 2.

Further, nozzles 15 are respectively fixed at two ends of the high-pressure spray head 5, and the nozzles 15 are used for outputting the medium. The nozzle 15 is a wear-resistant nozzle, which is reinforced to ensure that it may withstand the high-pressure injection of the medium.

The device further includes a liquid supply unit, and a liquid outlet end is in communication with the high-pressure spray head 5. The liquid supply unit is used to provide the medium with abrasive to the high-pressure spray head 5, so as to realize slotting construction.

In some embodiments, with reference to FIG. 8 and FIG. 9, the device further includes a height-adjusting bracket 7 configured to be adjustable in a height direction; and a horizontal guide rail 8 fixed at a top end of the height-adjusting bracket 7, and the horizontal guide rail 8 is slidably connected with the high-pressure spray head 5 and the drill pipe 6 through the grooves 9.

Specifically, the height-adjusting bracket 7 is used to support the horizontal guide rail 8, so that a height of the horizontal guide rail 8 may be changed, and the drilling holes 3 with different heights may be slit, and a bottom of the drill pipe 6 is ensured to be flush with a bottom of the drilling hole 3. The high-pressure spray head 5 is connected to a front end of the drill pipe 6, and then the high-pressure spray head 5 is inserted into the drilling hole 3, and the horizontal slotting is performed from shallow to deep.

The horizontal guide rail 8 is provided with two protruding blocks, and the protruding blocks are respectively in sliding fit with the grooves 9 on the drill pipe 6, so as to ensure the horizontal feed of the high-pressure spray head 5 and the nozzles 15 thereof.

In some embodiments, with reference to FIG. 7, the device further includes a pressure control valve 10 connected to a liquid inlet end of the high-pressure spray head 5 and configured to control a pressure at a liquid outlet end of the high-pressure spray head 5; and a pressure gauge 11 connected to the liquid inlet end of the high-pressure spray head 5 and configured to obtain the pressure at the liquid outlet end of the high-pressure spray head 5.

Specifically, the pressure control valve 10 is arranged on a liquid inlet pipeline of the high-pressure spray head 5, and the medium pressure output by the high-pressure spray head 5 may be adjusted through the pressure control valve 10. On the one hand, the pressure may be adjusted according to the strength of the surrounding rock 1, so that the medium pressure may be controlled in the slotting process, and on the other hand, the medium pressure may be adjusted to a smaller medium pressure to realize hydraulic slag discharge in the process of discharging rock debris.

The pressure gauge 11 is used to monitor the pressure of the liquid inlet pipeline of the high-pressure spray head 5 in real time, and adjust the pressure control valve 10 accordingly according to the obtained data.

In some embodiments, with reference to FIG. 7, the liquid supply unit includes a water tank 12 and a mixed abrasive box 13. A water inlet end of the mixed abrasive box is in communication with a water outlet end of the water tank 12, and a liquid outlet end of the mixed abrasive box is in communication with the liquid inlet end of the high-pressure spray head 5.

Specifically, the water tank 12 is used to supply water. After the water enters the mixed abrasive box 13, the abrasive may be fully and evenly mixed with the water to form a slotting medium, so as to avoid that the strength of the surrounding rock 1 is too large for the high-pressure water flow to finish slotting, and the slotting efficiency can be improved by adding abrasive.

Further, the water outlet end of the water tank 12 is connected with a water pump 14.

The above is only the preferred embodiment of the disclosure, but the protection scope of the disclosure is not limited to this. Any change or replacement that may be easily thought of by a person skilled in the art within the technical scope disclosed in the disclosure should be included in the protection scope of the disclosure. Therefore, the protection scope of the disclosure should be based on the protection scope of the claims.

What is claimed is:

1. A device for preventing rib spalling in a high-stress surrounding rock by hydraulic slotting, comprising:

a high-pressure spray head, wherein one end of the high-pressure spray head is connected to a drill pipe, an other end of the high-pressure spray head extends into a drilling hole, and the high-pressure spray head is configured to output a medium to form a pressure relief groove;

a liquid supply unit, wherein a liquid outlet end of the liquid supply unit is in communication with the high-pressure spray head;

a height-adjusting bracket configured to be adjustable in a height direction; and a horizontal guide rail fixed at a top end of the height-adjusting bracket, wherein the horizontal guide rail is slidably connected to the drill pipe through grooves on the drill pipe.

2. The device according to claim 1, further comprising:

a pressure control valve connected to a liquid inlet end of the high-pressure spray head and configured to control a pressure at a liquid outlet end of the high-pressure spray head; and a pressure gauge connected to the liquid inlet end of the high-pressure spray head and configured to obtain the pressure at the liquid outlet end of the high-pressure spray head.

3. The device according to claim 1, wherein the liquid supply unit comprises:

a water tank; and a mixed abrasive box, wherein a water inlet end of the mixed abrasive box is in communication with a water outlet end of the water tank, and a liquid outlet end of the mixed abrasive box is in communication with a liquid inlet end of the high-pressure spray head.

* * * * *